US011203910B2

(12) United States Patent
Wang et al.

(10) Patent No.: US 11,203,910 B2
(45) Date of Patent: Dec. 21, 2021

(54) CASING HANGER AND ANNULUS SEALING DEVICE RUNNING TOOL FOR DEEPWATER DRILLING, AND METHOD FOR USING THE SAME

(71) Applicant: CHINA UNIVERSITY OF PETROLEUM—BEIJING, Beijing (CN)

(72) Inventors: Yanbin Wang, Beijing (CN); Deli Gao, Beijing (CN); Jun Fang, Beijing (CN); Jing Zeng, Beijing (CN)

(73) Assignee: CHINA UNIVERSITY OF PETROLEUM—BEIJING, Beijing (CN)

( * ) Notice: Subject to any disclaimer, the term of this patent is extended or adjusted under 35 U.S.C. 154(b) by 41 days.

(21) Appl. No.: 16/923,429

(22) Filed: Jul. 8, 2020

(65) Prior Publication Data

US 2020/0370387 A1 Nov. 26, 2020

Related U.S. Application Data

(63) Continuation of application No. PCT/CN2018/107292, filed on Sep. 25, 2018.

(30) Foreign Application Priority Data

Apr. 27, 2018 (CN) ..... 201810389708.9

(51) Int. Cl.
*E21B 33/043* (2006.01)
*E21B 23/01* (2006.01)
(Continued)

(52) U.S. Cl.
CPC ..... *E21B 33/043* (2013.01); *E21B 7/12* (2013.01); *E21B 23/01* (2013.01); *E21B 33/12* (2013.01); *E21B 33/14* (2013.01); *E21B 34/04* (2013.01)

(58) Field of Classification Search
CPC ..... E21B 33/043; E21B 7/12; E21B 34/04; E21B 23/01
See application file for complete search history.

(56) References Cited

U.S. PATENT DOCUMENTS 4,597,448 A * 7/1986 Baugh ..... E21B 33/043 166/348
5,655,606 A 8/1997 Ferguson
(Continued)

FOREIGN PATENT DOCUMENTS

CN 102877810 A 1/2013
CN 205025395 U 2/2016
(Continued)

OTHER PUBLICATIONS

International Search Report dated Jan. 31, 2019 in corresponding International application No. PCT/CN2018/107292; 5 pages.

*Primary Examiner* — Catherine Loikith
(74) *Attorney, Agent, or Firm* — Maier & Maier, PLLC

(57) ABSTRACT

A casing hanger and annulus sealing device running tool for deepwater drilling and a method for using the same. The running tool includes a spindle connected to a hollow suspension structure via a torque transmission structure, one end of the spindle slidably passes through a hollow piston, the suspension structure rotates with the spindle and slide along the piston, the inner cavity of the torque transmission structure communicates with that of the suspension structure to form a piston cavity; the piston cavity and the piston form a hydraulic piston structure; and one end of the suspension structure away from the torque transmission structure can rotatably hook to and lift upward to release the annulus sealing device, and one end of the piston away from the torque transmission structure can radially expand to hook to the casing hanger and can radially contract to release the casing hanger.

12 Claims, 6 Drawing Sheets

(51) Int. Cl.

| | |
|---|---|
| ***E21B 34/04*** | (2006.01) |
| ***E21B 7/12*** | (2006.01) |
| ***E21B 33/12*** | (2006.01) |
| ***E21B 33/14*** | (2006.01) |

(56) References Cited

U.S. PATENT DOCUMENTS

| | | | | |
|---|---|---|---|---|
| 6,148,664 | A | 11/2000 | Baird | |
| 2018/0163500 | A1 * | 6/2018 | Levert | E21B 33/04 |

FOREIGN PATENT DOCUMENTS

| | | | | |
|---|---|---|---|---|
| CN | 107387026 | A | 11/2017 | |
| CN | 108386146 | A | 8/2018 | |
| CN | 208184692 | U | 12/2018 | |
| WO | WO-2019205479 | A1 * | 10/2019 | E21B 23/01 |

* cited by examiner

CASING HANGER AND ANNULUS SEALING DEVICE RUNNING TOOL FOR DEEPWATER DRILLING, AND METHOD FOR USING THE SAME

CROSS-REFERENCE TO RELATED APPLICATIONS

This application is a continuation of International Application No. PCT/CN2018/107292, filed on Sep. 25, 2018, which claims the priority benefit of China Patent Application No. 201810389708.9, filed on Apr. 27, 2018. The contents of the above identified applications are incorporated herein by reference in their entireties.

FIELD

The present invention relates to the field of marine deepwater drilling technologies, and in particular, to a casing hanger and annulus sealing device running tool for deepwater drilling and a method for using the same.

BACKGROUND

Marine oil and gas resources have become an important source of energy supply. High output, high investment and high risk are the characteristics of exploration and development operations of marine deepwater oil and gas. The subsea wellhead system is a basic component of deepwater drilling, well completion, and oil extraction and other operations. A multilayer casing hanger and annulus sealing device are installed inside the subsea wellhead, where the casing hanger is used to suspend a casing, and apply the weight of the casing string to the subsea wellhead, and the sealing device is used to seal an annulus space between the casing hanger and the subsea wellhead to isolate an external annulus space of the casing above and below the casing hanger. The casing hanger, the annulus sealing device and a running tool of them run to the subsea wellhead together. How to install the casing hanger and the sealing device is the key to lower the casing and continue drilling. A reasonable design of the running tool can reduce construction steps and installation difficulty, and improve the reliability of installation operation.

In the prior art, there is existed a casing hanger and a sealing running tool for marine deepwater drilling, the tool needs to throw blocking darts and other instruments when lowering the piston and installing the casing annulus sealing device under the hydraulic assistance, and needs to install corresponding equipments on the derrick, increasing wellhead operation steps.

Therefore, based on years of experience and practice in related industries, the inventor proposes a casing hanger and annulus sealing device running tool for deepwater drilling and a method of using the same, to overcome the defects of the prior art.

SUMMARY

An object of the present invention is to provide a casing hanger and annulus sealing device running tool for deepwater drilling and a method for using the same, to overcome the problems of complex installation, multiple matching equipment, high cost and so on in the prior art. The casing hanger and annulus sealing device running tool for deepwater drilling and the method for using thereof can achieve the requirements of installing a casing hanger and an annulus sealing device at a subsea wellhead on the seafloor, and have advantages of few installation and construction steps and low cost.

The object of the present invention is achieved as follows: a casing hanger and annulus sealing device running tool for deepwater drilling includes a hollow spindle, and an upper part of an outer wall of the spindle is hermetically connected to a hollow suspension structure via a hollow torque transmission structure, one end of the spindle away from the torque transmission structure slidably passes through a piston, an outer wall of the piston is connected to a lower part of an inner wall of the suspension structure in a sealed manner, an inner cavity of the suspension structure communicates with an inner cavity of the torque transmission structure to form a piston cavity, one end of the piston away from the torque transmission structure is located outside the piston cavity, the piston cavity and the piston form a hydraulic piston structure; a communication valve structure is provided between an inner wall of the torque transmission structure and the outer wall of the spindle, and the communication valve structure can communicate the piston cavity and an inner cavity of the spindle; the suspension structure includes a suspension cylinder capable of rotating with the spindle around a central axis, a bottom of an outer wall of the suspension cylinder is provided with an elastic pin capable of rotating to hook to and rotating to release an annulus sealing device, the elastic pin is capable of radially expansion and contraction; a lower part of an inner wall of the suspension cylinder is fixedly connected to a rotating cylinder in a sealed manner, the rotating cylinder can rotate with the suspension cylinder, an inner wall of the rotating cylinder is connected to the outer wall of the piston via a thread, and the piston and the rotating cylinder form a lead screw nut structure; one end of the piston away from the torque transmission structure is sleeved with an open type lock ring and the open type lock ring can open radically to hook to a casing hanger and contract radically to release the casing hanger.

In a preferred embodiment of the present invention, a bottom of the spindle is sleeved with a hollow lower joint, and a top of an outer wall of the lower joint can seal against an inner wall of the piston.

In a preferred embodiment of the present invention, a spindle through-hole that allows the spindle to slide therethrough in a sealed manner is provided inside the piston. A first diameter-enlarged hole with an enlarged inner diameter is provided below the spindle through-hole. A second diameter-enlarged hole is provided inward at one end of the piston away from the torque transmission structure. The first diameter-enlarged hole communicates with the second diameter-enlarged hole through a first tapered surface that has an inner diameter gradually increasing from top to bottom. The top of the outer wall of the lower joint can slide against an inner wall of the first diameter-enlarged hole in a sealed manner. The outer wall of the lower joint is provided with a first boss part, an outer wall of the first boss part slide against an inner wall of the second diameter-enlarged hole in a sealed manner. A top of the first boss part is provided with a second tapered surface capable of abutting against the first tapered surface in a sealed manner.

In a preferred embodiment of the present invention, the torque transmission structure includes a hollow connecting disc body that is sleeved on the spindle in a sealed manner. The communication valve structure is provided between an upper part of an inner wall of the connecting disc body and the outer wall of the spindle. The torque transmission structure further includes a hollow driving cylinder capable of moving axially along the spindle, a top of the driving cylinder can slide provided in an inner cavity of the connecting disc body in a sealed manner. The communication valve structure is in communication with the piston cavity, one end of the suspension cylinder is provided in an inner cavity of the driving cylinder, and the connecting disc body is fixedly connected with the suspension cylinder via a torque transmission bar. Outsides of the connecting disc body and the driving cylinder are provided with a centralizer structure.

In a preferred embodiment of the present invention, the centralizer structure includes an outer cylinder disposed coaxially with the driving cylinder; a top of the outer cylinder is fixedly connected to the connecting disc body. A lower part of a side wall of the outer cylinder is connected to a lower part of a side wall of the driving cylinder via a shear pin.

In a preferred embodiment of the present invention, the connecting disc body is connected with the spindle by a plurality of first connection pins; an upper part of a side wall of the connecting disc body is provided with a plurality of first through-holes. A side wall of the spindle is provided with first connection holes at positions corresponding to the first through-holes, and the first connection pins are connected to the inside of the first connection holes after passing through the first through-holes.

In a preferred embodiment of the present invention, an outer wall of the connecting disc body is sleeved with a first snap ring, and a bottom surface of the first snap ring abuts against a top surface of the torque transmission bar.

In a preferred embodiment of the present invention, the communication valve structure includes a valve body that abuts and is sleeved between the outer wall of the spindle and the inner wall of the connecting disc body. The outer wall of the spindle is provided with a first step part, the inner wall of the connecting disc body is provided with a second step part with a reduced diameter; one end surface of the valve body abuts against the first step part, and the other end surface of the valve body abuts against the second step part. A valve core hole through up and down is provided inside the valve body, a valve core is slidably provided inside the valve core hole. One end of the valve core is sleeved with a valve core spring. One end of the valve core spring abuts against the first step part, and the other end of the valve core passing through the valve body is located in the inner cavity of the driving cylinder. A valve core hole tapered surface with a diameter gradually decreasing from top to bottom is provided inside the valve core hole. The outer wall of the valve core is provided with a valve core tapered surface capable of matching with and sealing against the valve core hole tapered surface. The side wall of the spindle is provided with a first communication through-hole. A valve body communication hole that is in communication with the first communication through-hole is provided on a side wall of the valve core hole. One end of the valve core is inwardly provided with a first passage hole capable of communicating with the valve core hole and the valve body communication hole, the other end of the valve core is inwardly provided with a second passage hole capable of communicating with the piston cavity and the valve body communication hole. A bottom open of the first passage hole is located above the valve core tapered surface, and a top open of the second passage hole is located below the valve core tapered surface.

In a preferred embodiment of the present invention, a plurality of elastic lock blocks capable of radially expansion and contraction are provided on a side wall of the rotating cylinder at intervals along a circumferential direction, and a plurality of key grooves are provided on the inner wall of the suspension cylinder. The elastic lock blocks can protrude radially and radial outer sides of the elastic lock blocks can be respectively locked into corresponding key grooves. The outer wall of the piston above the key grooves is provided with piston grooves. The elastic lock blocks can radially contract and radial inner sides of the elastic lock blocks can slide in the piston grooves.

In a preferred embodiment of the present invention, one end of the rotating cylinder located outside the suspension cylinder can rotate to be sleeved on a top of an outer wall of a tapered sleeve, and the tapered sleeve has an outer diameter that is tapering from top to bottom. The rotating cylinder can push the tapered sleeve to move downward so as to open the open type lock ring.

In a preferred embodiment of the present invention, the tapered sleeve is provided with at least one tapered sleeve open type through slot with a bottom open, along an axial direction. The outer wall of the piston is fixedly provided with an anti-torsion key corresponding to the tapered sleeve open type through slot. The tapered sleeve open type through slot is slidably sleeved on circumferential two sides of the anti-torsion key.

The object of the present invention can also be achieved in the following way. A method for using the casing hanger and annulus sealing device running tool for deepwater drilling described above includes the following steps:

Step a: after the casing hanger and annulus sealing device running tool for deepwater drilling is connected with the annulus sealing device and the casing hanger, lift up the drill pipe, remove a slip, lower the drill pipe, to send the casing hanger and annulus sealing device running tool for deepwater drilling, the annulus sealing device, the casing hanger and the casing to a subsea wellhead;

Step b: pump cement into the drill pipe to start cementing;

Step c: lower the drill pipe, lock the casing hanger onto a step surface of the subsea wellhead, and mark a circumferential position and a vertical position of the drill pipe on a derrick;

Step d: rotate the drill pipe clockwise, the drill pipe then drives the spindle, the valve body, the connecting disc body, the torque transmission bar, the driving cylinder, the suspension cylinder and the rotating cylinder to rotate, the rotating cylinder drives the tapered sleeve to move upward, and when a bottom end surface of the tapered sleeve is parallel to a top end surface of the open type lock ring, the open type lock ring is contracted radially, and thereby the casing hanger and annulus sealing device running tool for deepwater drilling is released from the casing hanger;

Step e: continue to rotate the drill pipe clockwise for a predetermined number of turns, to allow the rotating cylinder to rotate and rise until the elastic lock blocks leave the key grooves, and when the rotating cylinder rotates and rises until the elastic lock blocks reach positions where the piston grooves are located, the elastic lock blocks are contracted radially, and their radial inner ends slide into the piston grooves, then the rotating cylinder separates from the suspension cylinder, and the rotating cylinder stops rotating;

Step f: lower the drill pipe, the drill pipe drives the connecting disc body, the torque transmission bar, the driving cylinder, the suspension cylinder, and the annulus sealing device to descend, the annulus sealing device is then sleeved on an outer wall of the casing hanger, and the second boss part on a top of the piston passes into the through-hole of the driving cylinder, the driving cylinder and the piston form a piston sealing structure, forming a hydraulic auxiliary piston;

Step g: drill pipe drives the spindle, the connecting disc body, the torque transmission bar, the driving cylinder, and the suspension cylinder to continue to descend, a volume of the piston cavity decreases, and a pressure in the piston cavity increases, the valve core moves upward, the second passage hole communicates with the inner cavity of the spindle through the valve body communication hole and the first communication through-hole, the piston cavity communicates with the inner cavity of the spindle, and the fluid in the piston cavity flows into the inner cavity of the spindle; the drill pipe continues to descend and when a displacement of the drill pipe in a vertical direction reaches a predetermined displacement, the top end surface of the second boss part pushes the valve core upward; the piston cavity communicates with the inner cavity of the spindle 1 via the second passage hole, the valve body communication hole and the first communication through-hole;

Step h: operate a hydraulic equipment at a derrick to pressurize the interior of the drill pipe, a high-pressure fluid enters the piston cavity through the first communication through-hole and the valve body communication hole, and the driving cylinder shears off the shear pin and continues to descend under the drive of the high-pressure fluid;

Step i: a bottom end surface of the driving cylinder transmits the hydraulic pressure to the annulus sealing device, the annulus sealing device seals the annulus space between the subsea wellhead and the casing hanger to insulate the annular pressure;

Step j: stop pressurizing, apply an axial tension to the drill pipe, to drive the spindle, the connecting disc body, the torque transmission bar, and the suspension cylinder to move upward, and the elastic pins are cut off under the action of the axial tension, the casing hanger and annulus sealing device running tool for deepwater drilling is released from the annulus sealing device; and Step k: pull the drill pipe upward, to raise the casing hanger and annulus sealing device running tool for deepwater drilling out of the subsea wellhead and to the derrick, completing installations of the casing hanger and the annulus sealing device.

As described above, the casing hanger and annulus sealing device running tool for deepwater drilling provided by the present invention and the method for using the same include the following beneficial effects:

the casing hanger and annulus sealing device running tool for deepwater drilling of the present invention can realize the requirements of installing the casing hanger and the annulus sealing device at the subsea wellhead on the seafloor, and fully use the torque transmission structure, the suspension structure, the hydraulic piston structure and the lead screw nut structure in combination, where the suspension cylinder can rotate to hook to and rotate to release the annulus sealing device, the bottom of the piston can hook to and release the casing hanger, the hydraulic piston structure can apply driving force to the annulus sealing device, and the sealing and releasing of the annulus sealing device and the casing hanger can be achieved by a method of rotating the drill pipe. The casing hanger and annulus sealing device running tool for deepwater drilling of the present invention have less difficulty in operation, and the method for using the same has simple implementation steps, high installation reliability, and low cost, which is conducive to popularization and use.

DETAILED DESCRIPTION

Figure 1:
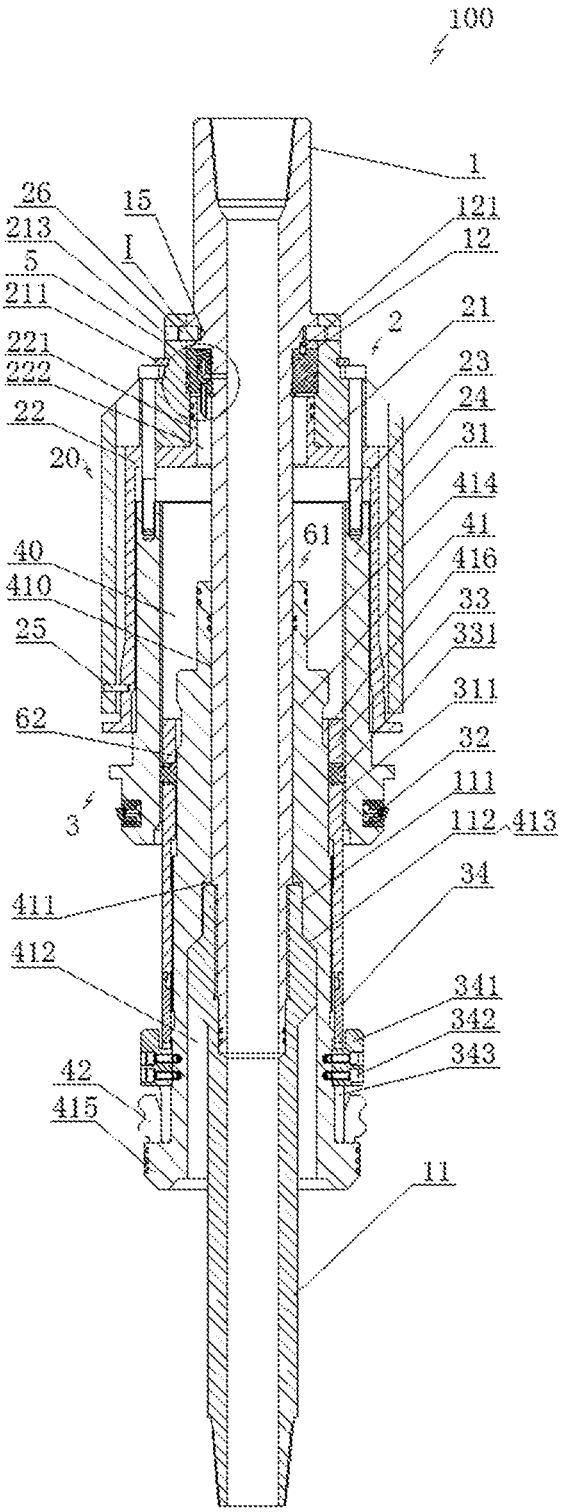
FIG. 1 is a schematic structural diagram of a casing hanger and annulus sealing device running tool for deepwater drilling of the present invention.
Figure 2:
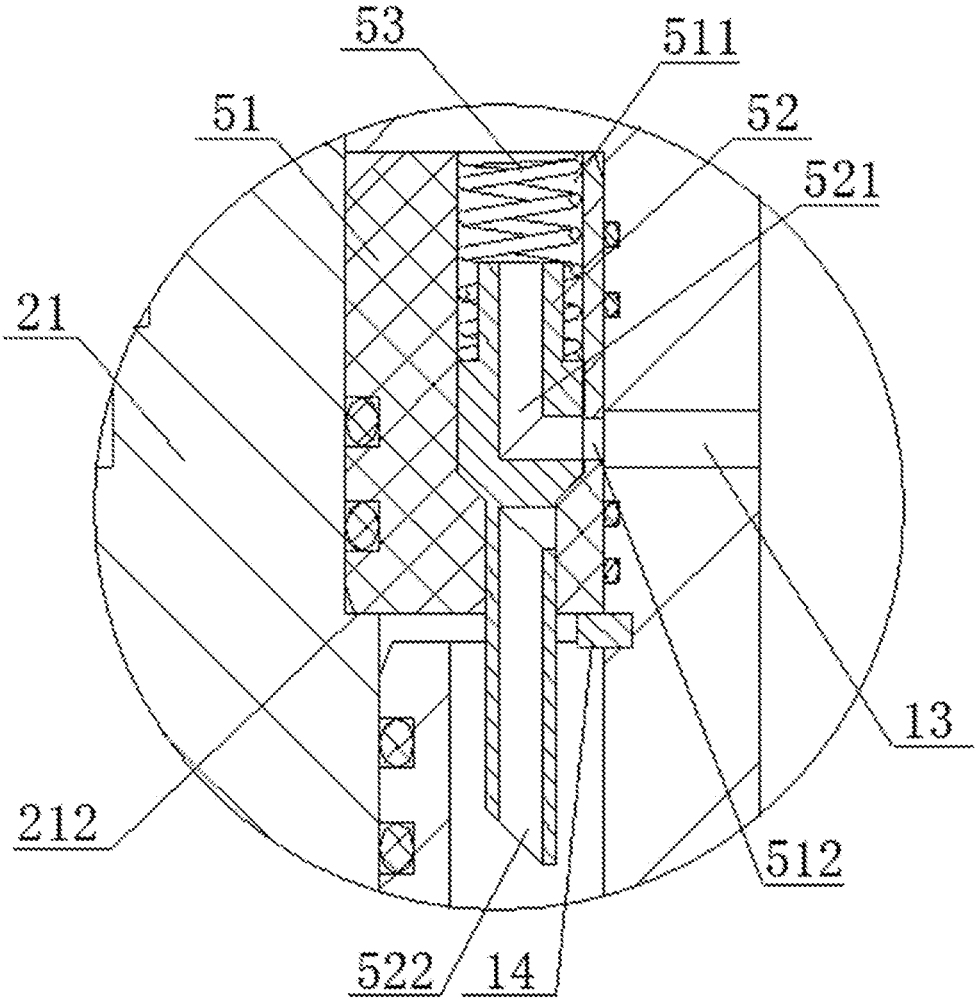
FIG. 2 is an enlarged diagram at I of FIG. 1.
Figure 3:
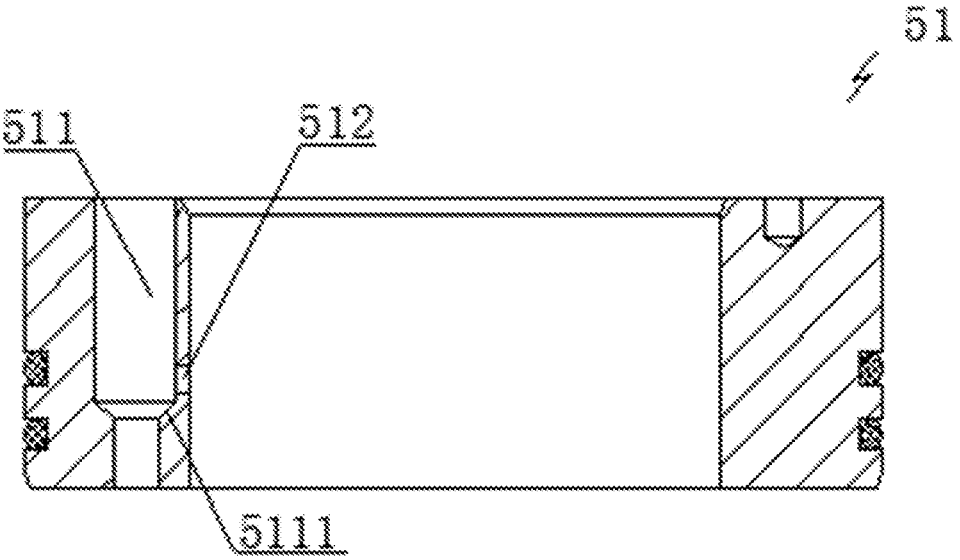
FIG. 3 is a structural diagram of a valve body of the present invention.
Figure 4:
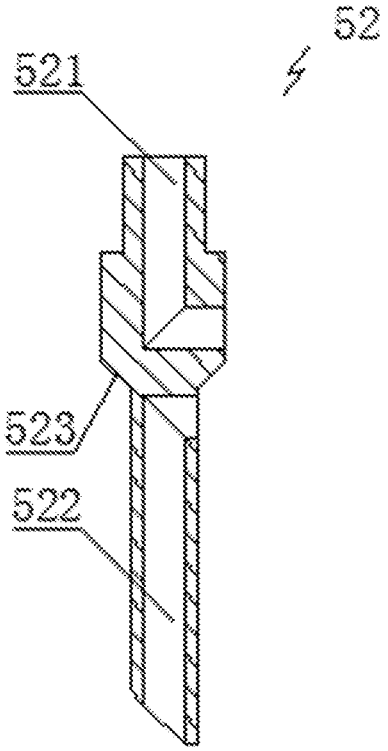
FIG. 4 is a schematic diagram of a valve core of the present invention.

In order to have a clearer understanding of the technical features, objects, and effects of the present invention, specific embodiments of the present invention will now be described with reference to the accompanying drawings.

As shown in FIGS. 1 to 7, the present invention provides a casing hanger and annulus sealing device running tool for deepwater drilling 100, which includes a hollow spindle 1, and a top of an inner wall of the spindle 1 is connected with a drill pipe 90 in a sealed manner, an upper part of an outer wall of the spindle 1 is connected to a hollow suspension structure 3 via a hollow torque transmission structure 2 in a sealed manner, one end of the spindle 1 away from the torque transmission structure 2 slidably passes through a piston 41, an outer wall of the piston 41 is connected with a lower part of an inner wall of the suspension structure 3 in a sealed manner, and an inner cavity of the suspension structure 3 communicates with an inner cavity of the torque transmission structure 2 to form a piston cavity 40, one end of the piston 41 away from the torque transmission structure 2 is located outside the piston cavity 40, and the piston cavity 40 and the piston 41 form a hydraulic piston structure 61; a communication valve structure 5 is provided between an inner wall of the torque transmission structure 2 and the outer wall of the spindle 1, the communication valve structure 5 can communicate the piston cavity 40 and the inner cavity of the spindle 1; the suspension structure 3 includes a suspension cylinder 31 capable of rotating with the spindle 1 around a central axis (central axis of the spindle 1), a bottom of an outer wall of the suspension cylinder 31 is provided with an elastic pin 32 capable of rotating to hook to and rotating to release an annulus sealing device 91 (prior art), the elastic pin can expand and contract in a radial direction (the radial direction refers to a diameter direction of the spindle 1), and there are a plurality of elastic pins 32. Grooves (prior art) are provided inside the annulus sealing device 91, the elastic pins 32 can radially extend to be locked in the grooves; a lower part of an inner wall of the suspension cylinder 31 is hermetically fixedly connected with a rotating cylinder 33, and the rotating cylinder 33 can rotate along with the suspension cylinder 31, and an inner wall of the rotating cylinder 33 is screwed to the outer wall of the piston 41, the piston 41 and the rotating cylinder 33 form a lead screw nut structure 62, and a rotational movement of the rotating cylinder 33 around the piston 41 is converted into an axial movement along the piston 41; one end of the piston 41 away from the torque transmission structure 2 is sleeved with an open type lock ring 42, the open type lock ring 42 can radially open to hook to the casing hanger 92 (prior art) and radially contract to release the casing hanger 92, the casing hanger 92 is fixedly connected with a casing 93 extending downward, the casing hanger 92 is provided with a casing hanger annulus groove (prior art), and the open type lock ring 42 can radially open and be locked in the casing hanger annulus groove to realize a hook connection between the casing hanger and annulus sealing device running tool for deepwater drilling 100 and the casing hanger 92.

The casing hanger and annulus sealing device running tool for deepwater drilling of the present invention can realize the requirements of installations of the casing hanger and the annulus sealing device at the subsea wellhead on the seafloor, and fully use the torque transmission structure, the suspension structure and the hydraulic piston structure and the lead screw nut structure in combination, where the suspension cylinder can rotate to hook to and rotate to release the annulus sealing device, the bottom of the piston can hook to and release the casing hanger, the hydraulic piston structure can apply a driving force to the annulus sealing device, and the sealing and releasing between the annulus sealing device and the casing hanger can be realized by a method of rotating the drill pipe. The casing hanger and annulus sealing device running tool for deepwater drilling of the present invention has less difficulty in operation, simple implementation steps, high installation reliability, and low cost, which is conducive to popularization and use.

Further, as shown in FIG. 1, the bottom of the spindle 1 is sleeved with a hollow lower joint 11. To ensure the sealing effect, a seal ring is provided between an inner wall of the lower joint 11 and the outer wall of the spindle 1; a top of an outer wall of the lower joint 11 abuts against the inner wall of the piston 41 in a sealed manner. A bottom of the lower joint 11 can communicate with a cement injection tool 94 (prior art) in a sealed manner. The spindle 1 and the lower joint 11 are hermetically communicated to form a connection structure of the casing hanger and annulus sealing device running tool for deepwater drilling 100, for realizing a connection of the casing hanger and annulus sealing device running tool for deepwater drilling 100 with the drill pipe. The spindle 1 and the lower joint 11 are connected in a detachable manner, which allows the casing hanger and annulus sealing device running tool for deepwater drilling 100 to be simply and conveniently removed and installed. The spindle 1 and the lower joint 11 are connected to form the connection structure of the casing hanger and annulus sealing device running tool for deepwater drilling 100, which may be used to transmit a torque and an axial force, suspend other components, and bear the gravity of the casing string (prior art, the casing hanger is installed on the top of the casing string) during installation.

Further, as shown in FIG. 1, the piston 41 is provided with a spindle through-hole 410 inside thereof, which allows the spindle 1 to slide through in a sealed manner. To ensure the sealing effect, a seal ring is provided between the spindle through-hole 410 and the outer wall of the spindle 1, the sealing ring can ensure the sealing of the piston cavity 40, prevent high-pressure fluid from leaking, and thus ensure the hydraulic pressure. A first diameter-enlarged hole 411 with an increased inner diameter is provided below the spindle through-hole 410, and a second diameter-enlarged hole 412 is provided inward at one end of the piston 41 away from the torque transmission structure 2. The first diameter-enlarged hole 411 communicates with the second diameter-enlarged hole 412 via a first tapered surface 413 with an inner diameter gradually expanding from top to bottom. The top of the outer wall of the lower joint 11 can slidably abut against the inner wall of the first diameter-enlarged hole 411 in a sealed manner, and the outer wall of the lower joint 11 is provided with a first boss part 111. An outer wall of the first boss part 111 can slidably abut against the inner wall of the second diameter-enlarged hole 412 in a sealed manner. The top of the first boss part 111 is provided with a second tapered surface 112 that is capable of abutting against the first tapered surface 413 in a sealed manner. The lower joint 11 can move up and down under a push-pull action of the spindle 1 above it. The outer wall of the first boss part 111 hermetically slides along the inner wall of the second diameter-enlarged hole 412 inside the piston 41. The bottom of the outer wall of the piston 41 is provided a piston boss part 415 with an enlarged diameter, and the bottom end surface of the open type lock ring 42 axially abuts against the top surface of the piston boss part 415. The inner wall of the casing hanger 92 is provided with a casing hanger inner tapered surface (prior art) with a diameter tapering downward. The bottom of the outer wall of the piston 41 is provided with a piston outer tapered surface matching with the casing hanger inner tapered surface. The piston outer tapered surface can be hermetically locked on the casing hanger inner tapered surface.

Further, as shown in FIG. 1, the torque transmission structure 2 includes a hollow connecting disc body 21 that is hermetically sleeved on the spindle 1, and a communication valve structure 5 is provided between the upper part of the inner wall of the connecting disc body 21 and the outer wall of the spindle 1. The torque transmission structure also includes a hollow driving cylinder 22 capable of moving axially along the spindle 1. The top of the driving cylinder 22 can slide within the inner cavity of the connecting disc body 21 in a sealed manner, and the connecting disc body 21 is located within the cavity below the communication valve structure 5, and the internal cavity of the driving cylinder 22 communicates with the internal cavity of the suspension cylinder 31 to form the aforementioned piston cavity 40. The top of the piston 41 is provided with a second boss part 414, and the top of the driving cylinder 22 is provided with a third boss part 221 with a reduced diameter. The third boss part 221 can be hermetically and slidably provided within the inner cavity of the connecting disc body 21 below the communication valve structure 5. The third boss part 221 is provided with a driving cylinder upper through-hole 222 which is penetrating in the axial direction. The outer diameter of the second boss part 414 is set to be the same as the diameter of the driving cylinder upper through-hole 222. The driving cylinder upper through-hole 222 can be hermetically and slidably sleeved on the outer wall of the second boss part 414. The driving cylinder 22 is located below the third boss part 221, and forms a third step part, and the third step part can axially abut against the lower end surface of the connecting disc body 21. In order to ensure the sealing effect, the outer wall of the driving cylinder 22 is provided with a sealing ring, and the outer wall of the sealing ring can abut against the inner wall of the connecting disc body 21 in a sealed manner. The sealing ring can ensure the sealing of the piston cavity 40 and prevent high-pressure fluid from leaking, ensuring the hydraulic pressure. The communication valve structure 5 is arranged in communication with the piston cavity 40, one end of the suspension cylinder 31 are arranged through in the inner cavity of the driving cylinder 22, and the connecting disc body 21 is fixedly connected to the suspension cylinder 31 via a plurality of torque transmission bar 23. In this embodiment, the connecting disc body 21 is provided with a plurality of first torque transmission bar through-holes running up and down, and the driving cylinder 22 is provided with second torque transmission bar through-holes corresponding to the first torque transmission bar through-holes. The top of the suspension cylinder 31 is provided with a plurality of connection threaded holes. The torque transmission bar 23 passes through the first torque transmission bar through-hole and the second torque transmission bar through-hole and then is fixedly connected to the inside of the connection threaded hole. A centralizer structure 20 is provided outside the connecting disc body 21 and the driving cylinder 22. In this embodiment, the centralizer structure 20 includes an outer cylinder 24 coaxially disposed with the driving cylinder 22. The top of the outer cylinder 24 is fixedly connected to the connecting disc body 21 and can be connected via a screw or a thread. The lower part of the side wall of the outer cylinder 24 is connected to the lower part of the side wall of the driving cylinder 22 via a shear pin 25. In this embodiment, the side wall of the driving cylinder 22 is provided with a pin fixing hole, and the number of the pin fixing hole is one or more. In order to make the connection more stable, a plurality of pin fixing holes are generally used. The side wall of the outer cylinder 24 is provided with a pin through-hole that is running in a radial direction and corresponding to the pin fixing hole. The shear pins 25 are fixed in the pin fixing hole by the pin through-hole. During the running process, the outer cylinder 24 can be sleeved within the subsea wellhead to ensure that the casing hanger and annulus sealing device running tool for deepwater drilling 100 is kept in a vertical state to avoid an accident caused by tilting. The below part of the side wall of the outer cylinder 24 is connected to the below part of the side wall of the driving cylinder 22 via the shear pin 25 before the casing hanger and annulus sealing device running tool for deepwater drilling 100 is assembled and seals the annulus sealing device. The driving cylinder 22 bears a downward hydraulic force during sealing, and when the hydraulic force is greater than the shearing force of the shear pin 25, the driving cylinder 22 moves downward to seal the annulus sealing device 91 so that the annulus sealing device 91 is locked at the subsea wellhead (prior art).

Further, as shown in FIG. 1, the connecting disc body 21 is connected to the spindle 1 via a plurality of first connection pins 26. A plurality of first through-holes 213 are provided at the upper part of the side wall of the connecting disc body 21. First connection holes 15 are provided on the side wall of spindle 1 at positions corresponding to the first through-holes 213, and the first connection pins 26 are connected into the first connection holes 15 after passing through the first through-holes 213. Use of the first connection pins 26 may achieve a fixed connection between the connecting disc body 21 and the spindle 1, so that the torque of the spindle can be stably transmitted to the suspension structure 3 through the connecting disc body 21.

Further, as shown in FIG. 1, a first snap ring 211 is sleeved on the outer wall of the connecting disc body 21, and the bottom surface of the first snap ring 211 abuts against the top surface of the torque transmission bar 23. The first snap ring 211 can make the torque transmission bar 23 transmit the torque more stably, limit the axial displacements of the torque transmission bar 23 and the suspension cylinder 31, preventing the torque transmission bar 23 and the suspension cylinder 31 from loosening.

Further, as shown in FIG. 1, FIG. 2, FIG. 3, and FIG. 4, the communication valve structure 5 includes a valve body 51 that abuts and is sleeved between the outer wall of the spindle 1 and the inner wall of the connecting disc body 21. A sealing ring is provided between the inner wall of the valve body 51 and the outer wall of the spindle 1. A first step part 12 is provided on the outer wall of the spindle 1, and a second step part 212 with a reduced diameter is provided on the inner wall of the connecting disc body 21. One end surface of the valve body 51 abuts against the first step part 12. In this embodiment, the first step part 12 is provided with a plurality of first positioning pins 121 extending downward, and one end surface of the valve body 51 is provided with locking holes capable of locking the first positioning pins 121. The valve body 51 is fixed in a circumferential direction via the first positioning pins 121. The other end surface of the valve body 51 abuts against the second step part 212. In this embodiment, in order to make the axial positioning of the valve body 51 more stable; a valve body snap ring 14 is sleeved at a position of the spindle 1 below the valve body 51. The bottom surface of the valve body 51 abuts against a top surface of the valve body snap ring 14. A valve core hole 511 running up and down is provided inside the valve body 51. A valve core 52 is slidably disposed in the valve core hole 511. A valve core convex column part with a reduced diameter is provided at one end of the valve core 52. A valve core step part is formed at a bottom position of the valve core convex column part of the valve core 52. A valve core spring 53 is sleeved outside the valve core convex column part, and one end of the valve core spring 53 abuts against the first step part 12, and the other end of the valve core spring 53 abuts against the valve core step part. The other end of the valve core 52 passing out from the valve body 51 is located in the inner cavity of the driving cylinder, and a first communication through-hole 13 is provided on the side wall of the spindle 1. A valve body communication hole 512 communicating with the first communication through-hole 13 is provided on the side wall of the valve core hole 511, and a valve core hole tapered surface 5111 with a diameter decreasing from top to bottom is provided inside the valve core hole 511. The outer wall of the valve core 52 is provided with a valve core tapered surface 523 capable of matching with and hermetically abutting against the valve core hole tapered surface, and one end of the valve core 52 is provided inwardly with a first passage hole 521 capable of communicating with the valve core hole 511 and the valve body communication hole 512, and the other end of the valve core 52 is provided inwardly with a second passage hole 521 capable of communicating with the piston cavity 40 and the valve body communication hole 512. The first passage hole 521 has a bottom open located above the valve core tapered surface, and the second passage hole 522 has a top open located below the valve core tapered surface. The valve core 52 is used to open or close a flow passage of the fluid in the inner cavity of the spindle 1 to realize the switching of fluid passages. When the valve core spring 53 pushes the valve core tapered surface to hermetically abut against and be locked to the valve core hole tapered surface, the first passage hole 521 communicates with the inner cavity of the spindle 1 through the valve body communication hole 512 and the first communication through-hole 13, and the valve core tapered surface and the valve core hole tapered surface form a tapered surface sealing, effectively blocking the piston cavity 40 from the inner cavity of the spindle 1. When the hydraulic pressure or pushing force on the lower end of the valve core 52 is higher than a combined force of a restoring force of the valve core spring 53 and an upper hydraulic pressure, the valve core 52 moves upward, the second passage hole 522 passes through the valve body communication hole 512 and the first communication through-hole 13 to communicate with the inner cavity of the spindle 1, and the piston cavity 40 below the valve core 52 communicates with the inner cavity of the spindle 1. The piston cavity 40 (the inner cavity of the suspension structure 3 and the internal cavity of the torque transmission structure 2) and the piston 41 form a hydraulic piston structure 61, which realizes the communication and non-communication with the internal cavity of the spindle 1 via the communication valve structure 5. The fluid in the inner cavity of the spindle 1 applies a pressure from a pump to the interior of the piston cavity 40 via the communication valve structure 5, and the hydraulic pressure of the fluid pushes the driving cylinder downward to seal the annulus sealing device 91.

Further, as shown in FIG. 1, a plurality of elastic lock blocks 331 capable of radially expansion and contraction are provided on the side wall of the rotating cylinder 33 at intervals along the circumferential direction. In this embodiment, a plurality of rotating cylinder-side through-holes are provided on the side wall of the rotating cylinder 33 at intervals along the circumferential direction. The elastic lock blocks 331 are respectively arranged within the rotating cylinder-side through-holes, radial inner sides of the elastic lock blocks 331 can be radially contracted into the inner cavity of the rotating cylinder 33, and radial outer sides of the elastic lock blocks 331 can radially protrude out of the outer wall of the rotating cylinder 33. The inner wall of the suspension cylinder 31 is provided with a plurality of key grooves 311. The elastic lock blocks 331 can radially extend and the radial outer sides of the elastic lock blocks 331 can be respectively locked into the corresponding key grooves 311. The piston grooves 416 are provided on the outer wall of the piston 41 above the key grooves. The elastic lock blocks 331 can radially contract and the radial inner sides of the elastic lock blocks 331 slide into the piston grooves 416. When the rotating cylinder 33 is assembled in the suspension cylinder 31, the rotating cylinder 33 is first pushed into the suspension cylinder 31 in the axial direction, and at this time, the radial outer sides of the elastic lock blocks 331 are radially compressed. When the elastic lock blocks 331 and the key grooves 311 are located at the same axial position, the rotating cylinder 33 is rotated so that the radial outer sides of the elastic lock blocks 331 extends radially and is locked in the corresponding key grooves 311, achieving a fixed connection between the rotating cylinder 33 and the suspension cylinder 31. After the casing hanger and annulus sealing device running tool for deepwater drilling 100 is assembled, the rotating cylinder 33 is sleeved on the outer wall of the piston 41 through a threaded connection, and the rotating cylinder 33 can rotate along the piston 41 to lift and drop. Rotating and lifting the rotating cylinder 33 allows the elastic lock blocks 331 to leave from the key grooves 311. When the rotating cylinder 33 raises until the elastic lock blocks 331 reach the piston grooves 416, the elastic lock blocks 331 radially contract and the radial inner sides thereof slide into the piston grooves 416, thereby the rotating cylinder 33 separating from the suspension cylinder 31.

Further, as shown in FIG. 1, one end of the rotating cylinder 33 outside the suspension cylinder 31 can rotate and be axially and fixedly sleeved on a top of an outer wall of a tapered sleeve 34. The outer diameter of the tapered sleeve 34 is tapered from top to bottom. The rotating cylinder 33 can push the tapered sleeve 34 to move downward and open the open type lock ring 42. The tapered sleeve 34 moves downward to abut against the open type lock ring 42 from the top, to make the open type lock ring 42 radially open, and the tapered sleeve 34 moves upward away from the open type lock ring 42 to make the open type lock ring 42 contract radially. In this embodiment, the tapered sleeve 34 is a two-halves type structure, an annulus groove part is provided at the bottom of the outer wall of the rotating cylinder 33, an annulus boss part capable of being locked into the annulus groove part is provided at the top of the inner wall of the tapered sleeve 34. Such snap-fitting between the annulus boss part and the annulus groove part allows the rotating cylinder 33 to be rotatably sleeved on the outer wall of the tapered sleeve 34, and the rotating cylinder 33 and the tapered sleeve 34 to be relatively fixed axially. By such fitting, the rotating cylinder 33 transmits the axial force to the tapered sleeve 34, so that the tapered sleeve 34 is pushed or pulled to move up and down.

Further, as shown in FIG. 1, the tapered sleeve 34 is provided with at least one tapered sleeve open type through slot 343 with a bottom open, in the axial direction. The outer wall of the piston 41 is fixedly provided with an anti-torsion key 341 corresponding to the tapered sleeve open type through slot 343. In this embodiment, the anti-torsion key 341 is fixedly connected to the outer wall of the piston 41 via an anti-rotation screw 342. The tapered sleeve open type through slot 343 is slidably sleeved on two sides of the anti-torsion key 341 in the circumferential direction. The anti-torsion key 341 can effectively prevent the tapered sleeve 34 from rotating in the circumferential direction relative to the piston 41, and the tapered sleeve 34 can move up and down by pushing and pulling of the rotating cylinder 33 located above the tapered sleeve 34.

The casing hanger and annulus sealing device running tool for deepwater drilling 100 of the present invention is assembled in the following manner:

seal rings are sleeved at required positions on the outer wall of the spindle 1, and the first positioning pins 121 are mounted on the first step part 2; the valve core 52 is mounted into the valve core hole 511 of the valve body 51 so that the bottom open of the first passage hole 521 correspondingly communicates with the valve body communication hole 512, and the valve core spring 53 is sleeved on the valve core convex column part; the valve body 51 is sleeved from the bottom of the spindle 1, the first positioning pins 121 are latched respectively in corresponding locking holes of the valve body 51, the upper end surface of the valve body 51 tightly abuts against the first step part 12 in the circumferential direction, and the valve core spring 53 pushes the valve core tapered surface to seal against the valve core hole tapered surface, the first passage hole 521 communicates with the inner cavity of the spindle 1 through the valve body communication hole 512 and the first communication through-hole 13, the valve core tapered surface and the valve core hole tapered surface form a tapered surface sealing that blocks the piston cavity 40 from the inner cavity of the spindle 1, and the valve body snap ring 14 is sleeved from the bottom of the spindle 1;

the connecting disc body 21 is sleeved from the bottom of the spindle 1, and the second step part 212 inside the connecting disc body 21 axially abuts against the lower end surface of the valve body 51, so that the first through-holes 213 on the side wall of the connecting disc body 21 are opposite to the first connection holes 15, the first connection pins 26 pass through the first through-holes 213 and then are connected into the first connection holes 15; the outer cylinder 24 is sleeved from the bottom of the connecting disc body 21 and is connected via a screw or a thread; the driving cylinder 22 is sleeved from the bottom of the spindle 1, and the third boss part 221 is set in the inner cavity of the connecting disc body 21 below the communication valve structure 5, and the third step part axially abuts against the bottom end surface of the connecting disc body 21, the driving cylinder 22 is rotated so that the pin fixing hole on the side wall thereof is opposite to the pin through-hole on the side wall of the outer cylinder 24, the shear pin 25 is fixed into the pin fixing hole via the pin through-hole; the suspension cylinder 31 is sleeved into the driving cylinder 22 from the bottom of the spindle 1 and the suspension cylinder 31 is rotated so that the connection threaded holes are opposite to the first torque transmission bar through-hole of connecting disc body 21 and the second torque transmission bar through-hole of the driving cylinder 22, the torque transmission bar 23 passes through the first torque transmission bar through-hole and the second torque transmission bar through-hole and then is fixedly connected to the connection threaded holes;

the open type lock ring 42 is sleeved from the top of the piston 41, and the bottom end surface of the open type lock ring 42 axially abuts against the top surface of the piston boss part 415, and the anti-torsion keys 341 is fixed onto the outer wall of the piston 41; the rotating cylinder 33 is rotatably sleeved on the outer wall of the piston 41 from the top of the piston 41, and the rotating cylinder 33 is rotated counterclockwise (left-rotating, the direction of rotation can be adjusted according to actual needs) to move downward, so that the two-halves type tapered sleeve 34 rotates to be locked to the bottom of the rotating cylinder 33, the rotating cylinder 33 continues to be rotated to push the tapered sleeve 34 to move downward to the top of the open type lock ring 42, the tapered sleeve 34 is rotated so that the tapered sleeve open type through slot 343 is aligned with the anti-torsion keys 341, respectively, and the rotating cylinder 33 continues to be rotated counterclockwise to move downward, and the tapered sleeve open type through slots 343 are respectively slidably sleeved on circumferential two sides of the anti-torsion keys 341;

the elastic lock blocks 331 are installed on the side wall of the rotating cylinder 33, the piston 41, the rotating cylinder 33 and the tapered sleeve 34, which are as a whole, are sleeved from the bottom of the spindle 1, and the rotating cylinder 33 is rotated clockwise (right-rotating), so that the radial outer side of the elastic lock blocks 331 stretch out radially and be locked in the corresponding key grooves 311 of the suspension cylinder 31, completing the fixed connection between the rotating cylinder 33 and the suspension cylinder 31; the lower joint 11 is hermetically connected to the spindle 1 via a thread, and the elastic pins 32 are installed at the bottom of the outer wall of the suspension cylinder 31, and then, as shown in FIG. 1, the assembly of the casing hanger and annulus sealing device running tool for deepwater drilling 100 is completed.

Figure 5:
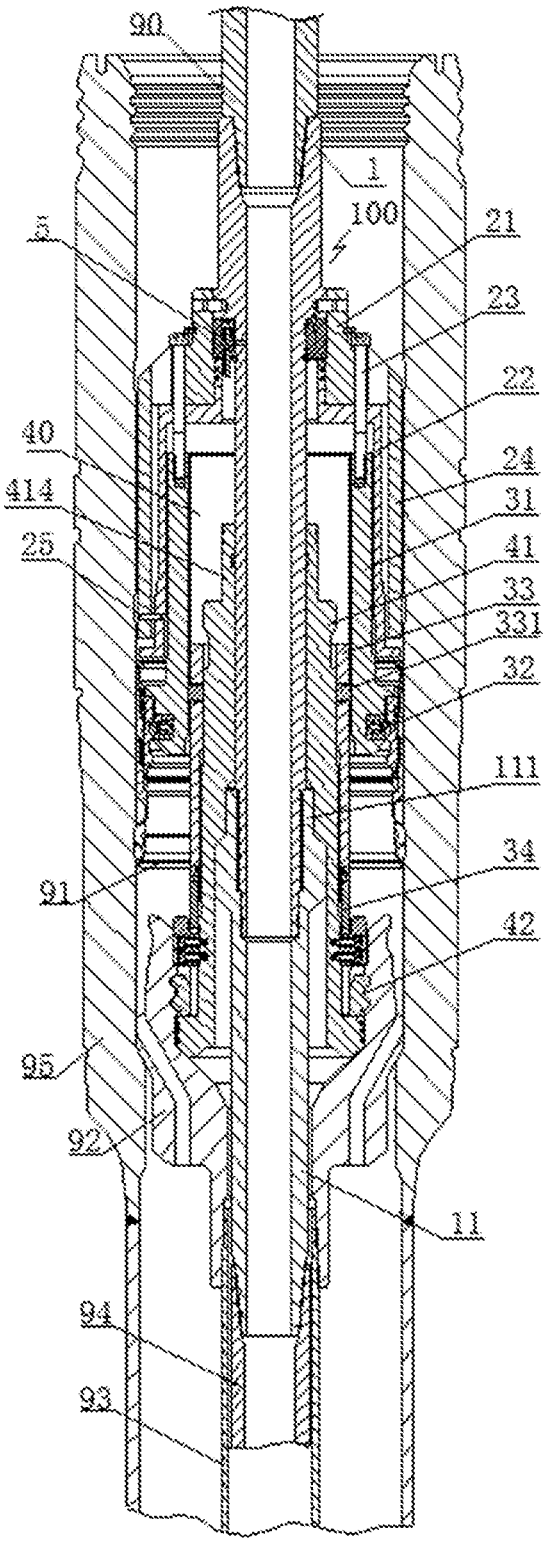
FIG. 5 is a schematic diagram of an initial state in which the casing hanger and annulus sealing device running tool for deepwater drilling of the present invention is lowered for construction.

When the casing hanger and annulus sealing device running tool for deepwater drilling 100 of the present invention needs to be used to lower the casing hanger 92, the casing 93, the annulus sealing device 91 and the cement injection tool into the well, as shown in FIG. 5, the lower joint 11 is connected with the cement injection tool 94 in a sealed manner, and the top of the spindle 1 is connected with the drill pipe 90 in a sealed manner; the drill pipe 90 is used to lift the casing hanger and annulus sealing device running tool for deepwater drilling 100 so that the casing hanger and annulus sealing device running tool for deepwater drilling 100 is located above the annulus sealing device 91; the drill pipe 90 and the casing hanger and annulus sealing device running tool for deepwater drilling 100 are dropped into the annulus sealing device 91. When the elastic pins 32 contact with the inner wall of the annulus sealing device 91, the elastic pins 32 contract radially to permit the casing hanger and annulus sealing device running tool for deepwater drilling 100 to continue to descend. When the elastic pins 32 move downward to the grooves of the annulus sealing device 91, the elastic pins 32 can extend radially and be locked in the grooves, and stop running into the drill pipe 90, and the connection between the casing hanger and annulus sealing device running tool for deepwater drilling 100 and the annulus sealing device 91 is completed.

The drill pipe 90 is lifted up, and the casing hanger and annulus sealing device running tool for deepwater drilling 100 and the annulus sealing device 91 are moved to a derrick (prior art). The casing hanger 92 and the casing 93, which are connected together, are placed on the derrick. The drill pipe 90 is lowered, and when the piston outer tapered surface at the bottom of the outer wall of the piston 41 and the casing hanger inner tapered surface of the inner wall of the casing hanger 92 are sealed against each other, the lowering is stopped.

The drill pipe 90 is rotated counterclockwise (left-rotating) to drive the spindle 1, the connecting disc body 21, the torque transmission bar 23, the driving cylinder 22, the suspension cylinder 31, the elastic lock blocks 331 and the rotating cylinder 33 to rotate. Under the action of the lead screw nut structure formed by the rotating cylinder 33 and the piston 41, the rotating cylinder 33 pushes the tapered sleeve 34 to move downward, the open type lock ring 42 moves outward and spreads in the radial direction, and is locked into the casing hanger annulus groove of the casing hanger 92. When the bottom end surface of the tapered sleeve 34 abuts axially against the top surface of the piston boss part 415, the rotation of the drill pipe 90 is stopped, and the connection between the casing hanger and annulus sealing device running tool for deepwater drilling 100 and the casing hanger 92 are completed.

Figure 6:
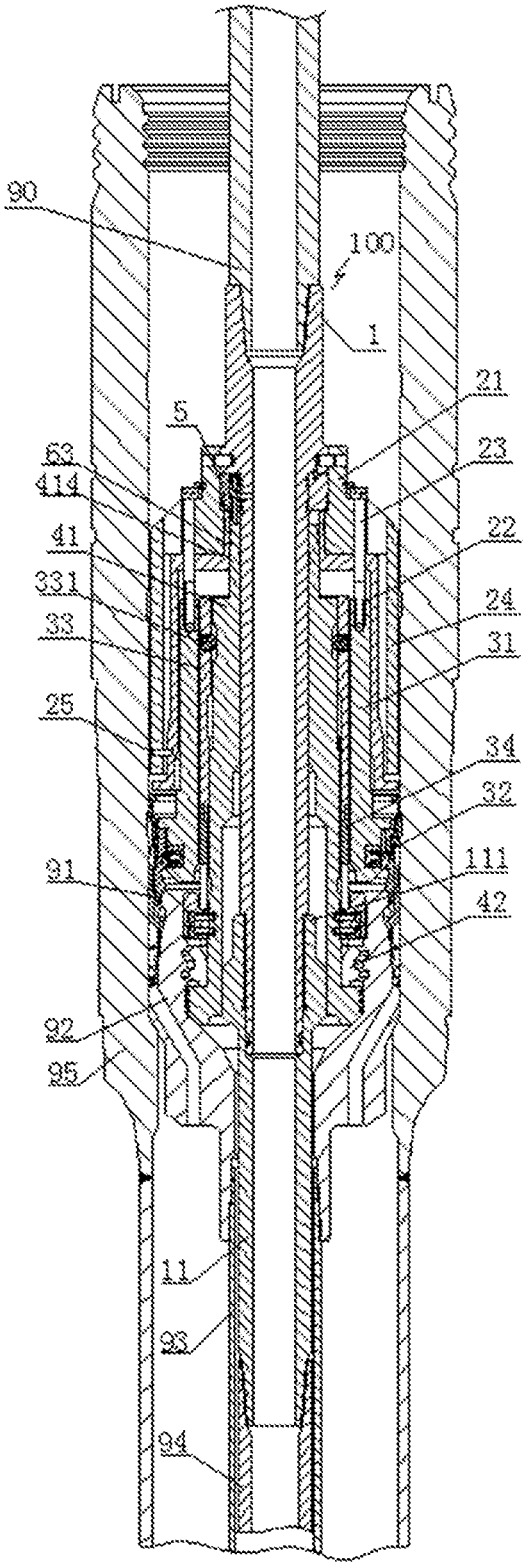
FIG. 6 is a schematic diagram of a release state in which the casing hanger and annulus sealing device running tool for deepwater drilling of the present invention is released from the casing hanger when being lowered for construction.
Figure 7:
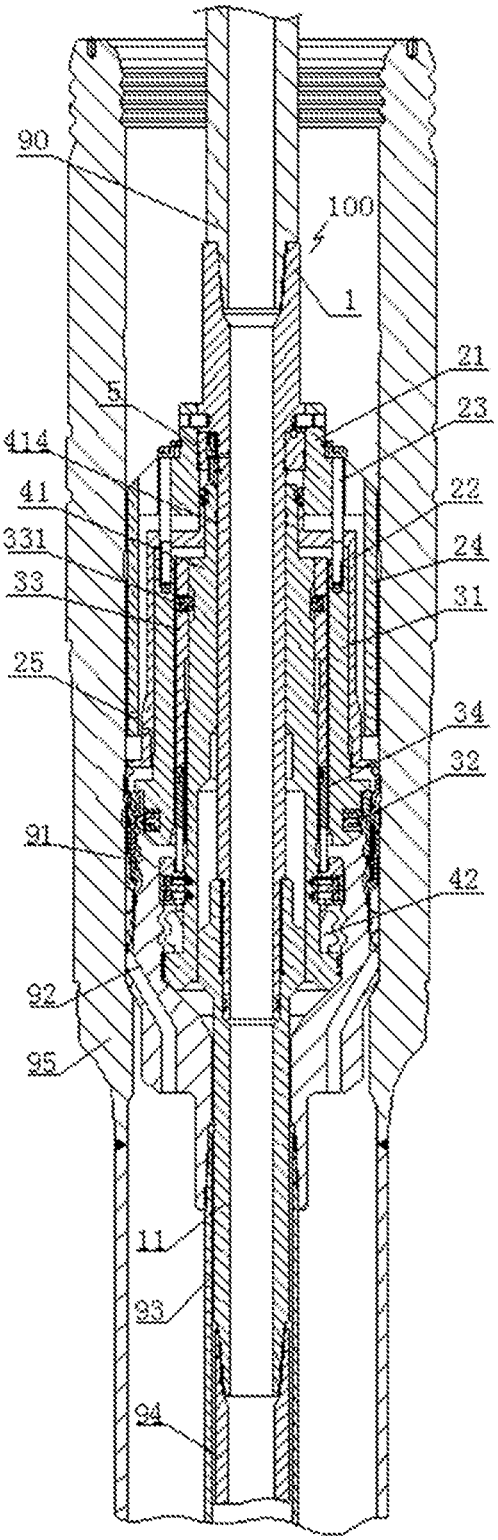
FIG. 7 is a schematic diagram of a state in which the casing hanger and annulus sealing device running tool for deepwater drilling of the present invention seals the annulus sealing device when being lowered for construction.

The method for lowering the annulus sealing device 91 and the casing hanger 92 using the casing hanger and annulus sealing device running tool for deepwater drilling 100 is as follows:

Step a: after the casing hanger and annulus sealing device running tool for deepwater drilling 100 is connected with the annulus sealing device 91 and the casing hanger 92, lift up the drill pipe 90, remove a slip (prior art), lower the drill pipe 90, to send the casing hanger and annulus sealing device running tool for deepwater drilling 100, the annulus sealing device 91, the casing hanger 92, and the casing 93 to subsea wellhead;

Step b: pump cement into the drill pipe 90 to start cementing;

Step c: lower the drill pipe 90, lock the casing hanger 92 onto the step surface of the subsea wellhead 95 (prior art), and mark a circumferential position and a vertical position of the drill pipe 90 on a derrick (that is, mark the height and the circumferential angle of the drill pipe 90 above a turntable of the derrick; prior art);

Step d: rotate (right-rotate) the drill pipe 90 clockwise, drill pipe 90 drives the spindle 1, the valve body 51, the connecting disc body 21, the torque transmission bar 23, the driving cylinder 22, the suspension cylinder 31 and the rotating cylinder 33 to rotate, the rotating cylinder 33 drives the tapered sleeve 34 to move upward, and when a bottom end surface of the tapered sleeve 34 is parallel to a top end surface of the open type lock ring 42, the open type lock ring 42 contracts radially due to its own elastic force, and the casing hanger and annulus sealing device running tool for deepwater drilling 100 releases from the casing hanger 92, and the state is shown in FIG. 6;

Step e: continue to rotate (right-rotate) the drill pipe 90 clockwise for a predetermined number of turns (determined by an actual situation), to allow the rotating cylinder 33 to rotate and rise to a certain height, so that the elastic lock blocks 331 leave the key grooves, and when the rotating cylinder 33 rises until the elastic lock blocks reach positions where the piston grooves are located, the elastic lock blocks 331 contract radially and their radial inner sides slide into the piston grooves 416, then the rotating cylinder 33 separates from the suspension cylinder 31, and the rotating cylinder 33 stops rotating;

Step f: lower the drill pipe 90, and the drill pipe 90 drives the connecting disc body 21, the torque transmission bar 23, the driving cylinder 22, the suspension cylinder 31, and the annulus sealing device 91 to descend, the annulus sealing device 91 is then sleeved on an outer wall of the casing hanger 92, and the second boss part 414 on the top of the piston 41 passes into the through-hole 222 of the driving cylinder, the driving cylinder 22 and the piston 41 form a piston sealing structure 63, forming a hydraulic auxiliary piston;

Step g: the drill pipe 90 drives the spindle 1, the connecting disc body 21, the torque transmission bar 23, the driving cylinder 22, and the suspension cylinder 31 to continue to descend, a volume of the piston cavity 40 further decreases, and a pressure in the piston cavity 40 increases, and under the pressure in the piston cavity 40, the valve core 52 moves upward, the second passage hole 522 communicates with the inner cavity of the spindle 1 through the valve body communication hole 512 and the first communication through-hole 13, the piston cavity 40 below the valve core 52 communicates with the inner cavity of the spindle 1, and the fluid in the piston cavity 40 flows into the inner cavity of the spindle 1; the drill pipe 90 continues to descend and when the vertical displacement of the drill pipe 90 reaches a predetermined displacement, the top end surface of the second boss part 414 pushes the valve core 52 upward; the piston cavity 40 is always in communication with the inner cavity of the spindle 1 through the second passage hole 522, the valve body communication hole 512 and the first communication through-hole 13;

Step h: operate a hydraulic equipment at a derrick to pressurize the interior of the drill pipe 90, a high-pressure fluid (after operating the hydraulic equipment at the derrick to pressurize the interior of the drill pipe 90, the fluid has an elevated pressure to form the high-pressure fluid) enters into the piston cavity 40 through the first communication through-hole 13 and the valve body communication hole 512, and the driving cylinder 22 shears off the shear pin 25 and continues to descend under the drive of the high-pressure fluid;

Step i: a bottom end surface of the driving cylinder 22 transmits the hydraulic pressure to the annulus sealing device 91, the annulus sealing device 91 seals the annulus space between the subsea wellhead and the casing hanger 92, and thereby the annulus below the annulus sealing device 91 is separated from the upper wellbore, as shown in FIG. 7;

Step j: stop pressurization, apply an axial tension to the drill pipe 90, to drive the spindle 1, the connecting disc body 21, the torque transmission bar 23, and the suspension cylinder 31 to move upward, and the elastic pins 32 are cut off under the action of the axial tension, and thereby the casing hanger and annulus sealing device running tool for deepwater drilling 100 releases from the annulus sealing device 91; and Step k: lift the drill pipe 90, to raise the casing hanger and annulus sealing device running tool for deepwater drilling 100 out of the subsea wellhead and to a derrick, completing installations of the casing hanger 92 and the annulus sealing device 91.

From the above, the casing hanger and annulus sealing device running tool for deepwater drilling and the use method thereof provided by the present invention include the following beneficial effects:

the casing hanger and annulus sealing device running tool for deepwater drilling of the present invention can realize the requirements of installing the casing hanger and the annulus sealing device at the subsea wellhead on the seafloor, and fully use the torque transmission structure, the suspension structure, the hydraulic piston structure and the lead screw nut structure in combination, where the suspension cylinder can rotate to hook to and rotate to release the annulus sealing device, the bottom of the piston can hook to and release the casing hanger, the hydraulic piston structure can apply a driving force to the annulus sealing device, and the sealing and releasing of the annulus sealing device and the casing hanger can be achieved by a method of rotating the drill pipe. The casing hanger and annulus sealing device running tool for deepwater drilling of the present invention has less difficulty in operation, and the method for using the same has simple implementation steps, high installation reliability, and low cost, which is conducive to popularization and use.

The above descriptions are merely exemplary embodiments of the present invention, and are not intended to limit the scope of the present invention. Any equivalent changes and modifications made by those skilled in the art without departing from the concept and principle of the present invention shall fall within the protection scope of the present invention.

What is claimed is:

1. A casing hanger and annulus sealing device running tool for deepwater drilling, comprising:

a hollow spindle, wherein an upper part of an outer wall of the spindle is hermetically connected to a hollow suspension structure via a hollow torque transmission structure, one end of the spindle away from the torque transmission structure slidably passes through a piston, and an outer wall of the piston is connected to a lower part of an inner wall of the suspension structure in a sealed manner, and an inner cavity of the suspension structure communicates with an inner cavity of the torque transmission structure to form a piston cavity, one end of the piston away from the torque transmission structure is located outside the piston cavity, the piston cavity and the piston form a hydraulic piston structure;

a communication valve structure is provided between an inner wall of the torque transmission structure and the outer wall of the spindle, and the communication valve structure communicates the piston cavity and an inner cavity of the spindle;

the suspension structure comprises a suspension cylinder capable of rotating with the spindle around a central axis, a bottom of an outer wall of the suspension cylinder is provided with an elastic pin capable of rotating to hook to and rotating to release an annulus sealing device, and the elastic pin is capable of expanding and contracting in a radial direction;

a lower part of an inner wall of the suspension cylinder is fixedly connected with a rotating cylinder in a sealed manner, the rotating cylinder is capable of rotating with the suspension cylinder, and an inner wall of the rotating cylinder is connected to the outer wall of the piston via a thread, the piston and the rotating cylinder form a lead screw nut structure; and one end of the piston away from the torque transmission structure is sleeved with an open type lock ring, the open type lock ring is capable of opening radially to hook to a casing hanger and contracting radially to release the casing hanger.

2. The casing hanger and annulus sealing device running tool for deepwater drilling according to claim 1, wherein a bottom of the spindle is sleeved with a hollow lower joint, a top of an outer wall of the lower joint is capable of sealing against an inner wall of the piston.

3. The casing hanger and annulus sealing device running tool for deepwater drilling according to claim 2, wherein the piston is internally provided with a spindle through-hole that allows the spindle to slide therethrough in a sealed manner, and a first diameter-enlarged hole with an enlarged inner diameter is provided below the spindle through-hole, and a second diameter-enlarged hole is provided at one end of the piston away from the torque transmission structure, and the first diameter-enlarged hole communicates with the second diameter-enlarged hole through a first tapered surface that has an inner diameter increasing gradually from top to bottom, the top of the outer wall of the lower joint is capable of sliding against an inner wall of the first diameter-enlarged hole in a sealed manner, the outer wall of the lower joint is provided with a first boss part, an outer wall of the first boss part is capable of sliding against an inner wall of the second diameter-enlarged hole in a sealed manner, and a top of the first boss part is provided with a second tapered surface capable of abutting against the first tapered surface in a sealed manner.

4. The casing hanger and annulus sealing device running tool for deepwater drilling according to claim 1, wherein the torque transmission structure comprises a hollow connecting disc body sleeved on the spindle in a sealed manner, the communication valve structure is provided between an upper part of an inner wall of the connecting disc body and the outer wall of the spindle, the torque transmission structure further comprises a hollow driving cylinder capable of moving axially along the spindle, and a top of the driving cylinder is capable sliding through an inner cavity of the connecting disc body in a sealed manner, the communication valve structure is in communication with the piston cavity, and one end of the suspension cylinder is provided in an inner cavity of the driving cylinder, the connecting disc body is fixedly connected with the suspension cylinder via a torque transmission bar; outsides of the connecting disc body and the driving cylinder are provided with a centralizer structure.

5. The casing hanger and annulus sealing device running tool for deepwater drilling according to claim 4, wherein the centralizer structure comprises an outer cylinder disposed coaxially with the driving cylinder, a top of the outer cylinder is fixedly connected to the connecting disc body, and a lower part of a side wall of the outer cylinder is connected to a lower part of a side wall of the driving cylinder via a shear pin.

6. The casing hanger and annulus sealing device running tool for deepwater drilling according to claim 4, wherein the connecting disc body is connected with the spindle by a plurality of first connection pins, an upper part of a side wall of the connecting disc body is provided with a plurality of first through-holes, a side wall of the spindle is provided with first connection holes at positions corresponding to the first through-holes, the first connection pins are connected to the inside of the first connection holes after passing through the first through-holes.

7. The casing hanger and annulus sealing device running tool for deepwater drilling according to claim 4, wherein an outer wall of the connecting disc body is sleeved with a first snap ring, a bottom surface of the first snap ring abuts against a top surface of the torque transmission bar.

8. The casing hanger and annulus sealing device running tool for deepwater drilling according to claim 4, wherein the communication valve structure comprises a valve body that abuts and is sleeved between the outer wall of the spindle and the inner wall of the connecting disc body, the outer wall of the spindle sets a first step, and the outer wall of the spindle is provided with a first step part, the inner wall of the connecting disc body is provided with a second step part with a reduced diameter, one end surface of the valve body abuts against the first step part, an other end surface of the valve body abuts against the second step part, a valve core hole is provided inside the valve body, a valve core is slidably provided inside the valve core hole, one end of the valve core is sleeved with a valve core spring, one end of the valve core spring abuts against the first step part, and an other end of the valve core passing through the valve body is located in the inner cavity of the driving cylinder; a valve core hole tapered surface with a diameter gradually decreasing from top to bottom is provided inside the valve core hole, an outer wall of the valve core is provided with a valve core tapered surface capable of matching with and sealing against the valve core hole tapered surface, a side wall of the spindle is provided with a first communication through-hole, a valve body communication hole that is in communication with the first communication through-hole is provided on a side wall of the valve core hole, one end of the valve core is inwardly provided with a first passage hole capable of communicating with the valve core hole and the valve body communication hole, an other end of the valve core is inwardly provided with a second passage hole capable of communicating with the piston cavity and the valve body communication hole, a bottom opening of the first passage hole is located above the valve core tapered surface, and a top opening of the second passage hole is located below the valve core tapered surface.

9. The casing hanger and annulus sealing device running tool for deepwater drilling according to claim 1, wherein a plurality of elastic lock blocks capable of radial expansion and contraction are provided on a side wall of the rotating cylinder at intervals along a circumferential direction, a plurality of key grooves are provided on the inner wall of the suspension cylinder, the elastic lock blocks protrude radially and radial outer sides of the elastic lock blocks are respectively locked into corresponding key grooves, the outer wall of the piston above the key grooves is provided with piston grooves, the elastic lock blocks are capable of radial contraction and radial inner sides of the elastic lock blocks are capable of sliding in the piston grooves.

10. The casing hanger and annulus sealing device running tool for deepwater drilling according to claim 1, wherein one end of the rotating cylinder located outside the suspension cylinder is rotatably sleeved on a top of an outer wall of a tapered sleeve, the tapered sleeve has an outer diameter that is tapering from top to bottom, the rotating cylinder is capable of pushing the tapered sleeve to move downward so as to open the open type lock ring.

11. The casing hanger and annulus sealing device running tool for deepwater drilling according to claim 10, wherein the tapered sleeve is provided with at least one tapered sleeve open type through slot with a bottom open, along an axial direction, and the outer wall of the piston is fixedly provided with an anti-torsion key corresponding to the tapered sleeve open type through slot, and the tapered sleeve open type through slot is slidably sleeved on circumferential two sides of the anti-torsion key.

12. A method for using the casing hanger and annulus sealing device running tool for deepwater drilling according to claim 1, comprising the following steps:

Step a: after the annulus sealing device running tool for deepwater drilling is connected with the annulus sealing device and the casing hanger, lifting up a drill pipe, removing a slip, lowering the drill pipe, and sending the annulus sealing device running tool for deepwater drilling, the annulus sealing device, the casing hanger, and the casing to a subsea wellhead;

Step b: pumping cement into the drill pipe to start cementing;

Step c: lowering the drill pipe, locking the casing hanger on a step surface of the subsea wellhead, and marking a circumferential position and a vertical position of the drill pipe on a derrick;

Step d: rotating the drill pipe clockwise, driving, by the drill pipe, the spindle, a valve body, the connecting disc body, a torque transmission bar, a driving cylinder, the suspension cylinder and the rotation cylinder to rotate, driving, by the rotating cylinder, a tapered sleeve to move upward, and when a bottom end surface of the tapered sleeve is parallel to a top end surface of the open type lock ring, subjecting the open type lock ring to radial contraction, to release the annulus sealing device running tool for deepwater drilling from the casing hanger;

Step e: continuing to rotate the drill pipe clockwise for a predetermined number of turns, to allow the rotating cylinder to rotate and rise until elastic lock blocks leave key grooves, and when the rotating cylinder rises until the elastic lock blocks reach positions where piston grooves are located, subjecting the elastic lock blocks to radial contraction, with their radial inner ends sliding into the piston grooves, so that the rotating cylinder separates form the suspension cylinder, and the rotating cylinder stops rotating;

Step f: lowering the drill pipe, and driving, by the drill pipe, the connecting disc body, the torque transmission bar, the driving cylinder, the suspension cylinder, and the annulus sealing device to descend so that the annulus sealing device is sleeved on an outer wall of the casing hanger and a second boss part on a top of the piston passes into a through-hole on the driving cylinder, and forming, by the driving cylinder and the piston, a piston sealing structure, to form a hydraulic auxiliary piston;

Step g: driving, by the drill pipe, the spindle, the connecting disc body, the torque transmission bar, the driving cylinder, and the suspension cylinder to continue to descend, with a volume of the piston cavity decreasing and a pressure in the piston cavity increasing, to allow a valve core to move upward, a second passage hole communicating with the inner cavity of the spindle through a valve body communication hole and a first communication through-hole, and the piston cavity communicating with the inner cavity of the spindle to allow a fluid in the piston cavity to flow into the inner cavity of the spindle; making the drill pipe continue to descend and when a vertical displacement of the drill pipe reaches a predetermined displacement, pushing, by a top end surface of the second boss part, the valve core upward, and the piston cavity communicating with the inner cavity of the spindle through the second passage hole, the valve body communication hole and the first communication through-hole;

Step h: operating a hydraulic equipment at the derrick to pressurize an interior of the drill pipe, a high-pressure fluid entering the piston cavity through the first communication through-hole and the valve body communication hole, and under the drive of the high-pressure fluid, the driving cylinder shearing off a shear pin and continuing to descend;

Step i: transmitting, by a bottom end surface of the driving cylinder, a corresponding hydraulic pressure to the annulus sealing device, the annulus sealing device sealing an annulus space between the subsea wellhead and the casing hanger;

Step j: stopping pressurizing, applying an axial tension to the drill pipe, to drive the spindle, the connecting disc body, the torque transmission bar, and the suspension cylinder to move upward, and under the action of the axial tension, shearing off the elastic pin, the casing hanger and annulus sealing device running tool for deepwater drilling releasing from the annulus sealing device; and Step k: pulling the drill pipe upward, to raise the casing hanger and annulus sealing device running tool for deepwater drilling out of the subsea wellhead and to the derrick, completing installations of the casing hanger and the annulus sealing device.

* * * * *